US005987654A

United States Patent [19]

Chartrand

[11] Patent Number: 5,987,654

[45] Date of Patent: Nov. 23, 1999

[54] LIGHT-WEIGHT SHOULDER PADS

[75] Inventor: Daniel Chartrand, Deux-Montagnes, Canada

[73] Assignee: Bauer, Inc., Canada

[21] Appl. No.: 08/974,844

[22] Filed: Nov. 20, 1997

[51] Int. Cl.[6] ..... A41D 13/00

[52] U.S. Cl. ..... 2/462

[58] Field of Search ..... 2/455, 459, 461, 2/462, 463, 467, 44, 45

[56] References Cited

U.S. PATENT DOCUMENTS

| | | | |
|---|---|---|---|
| 1,094,865 | 4/1914 | Pierce | 2/461 |
| 1,862,442 | 6/1932 | Till | 2/462 |
| 3,431,560 | 3/1969 | Austin | 2/462 |
| 3,739,397 | 6/1973 | Truelove | 2/462 |
| 4,320,537 | 3/1982 | Mitchell | 2/462 |
| 4,590,622 | 5/1986 | Wolfe et al. | 2/462 |
| 4,698,845 | 10/1987 | Cosby | 2/462 |
| 5,390,368 | 2/1995 | Chang | 2/462 |

*Primary Examiner*—Michael A. Neas

*Attorney, Agent, or Firm*—Finnegan, Henderson, Farabow, Garrett & Dunner, L.L.P.

[57] ABSTRACT

A padded protective garment to be worn on the upper body of a user comprises a number of padded panels for positioning against the chest and back regions to cover the shoulders and a major part of the rib cage of the wearer. The garment also includes an external shell comprising generally vertically extending stiffener bands provided in laterally spaced pairs for overlying portions of the front and rear padded sections. The stiffener bands at their upper ends are connected to shoulder arches and are fabricated from a stiffly flexible material so as to be able to attenuate localized impact forces and distribute such forces to an enlarged region of the underlying padding layers.

12 Claims, 10 Drawing Sheets

LIGHT-WEIGHT SHOULDER PADS

BACKGROUND OF THE INVENTION a) Field of the Invention

This invention relates to a new or improved protective garment to be worn on the upper body of a user to provide a measure of protection against blows to the shoulders and the torso. The invention is particularly although not exclusively concerned with the provision of the kind of protective garment that is commonly referred to as "shoulder pads" as used for ice hockey and other contact sports.

b) Description of the Prior Art

The participants in contact sports, and in particular in ice hockey, are subjected to frequent blows not just from the bodies of opposing players, but also from contact, for example, with rink boards, goal posts, sticks, pucks, skates, and the ice surface. Numerous protection systems of shoulder pads have been proposed in the past and are available on the market.

Unfortunately, maximizing the protective properties of such systems necessarily entails restriction in the freedom of movement of the arms, neck and torso of the player, so that a compromise has to be reached between the amount of protection afforded by a protective garment and the restriction which the garment imposes upon the freedom of movement of the wearer. Generally, more skilful and experienced ice hockey players tend to favour garments which maximize the player's freedom of movement while still providing some degree of protection, whereas amateur and younger players require equipment which maximizes the degree of protection without excessively limiting their freedom of movement.

SUMMARY OF THE INVENTION

The aim of the present invention is to provide a protective garment which will provide the wearer with a substantial amount of protection from impacts, while not excessively restricting the wearer's freedom of movement.

The invention accordingly provides a padded protective garment to be worn on a person's upper body, comprising an absorption structure to be positioned adjacent the body and an external shell disposed outwardly on said absorption structure, said absorption structure comprising: a front section, a rear section and a shoulder section each comprising layers of padding for overlying the chest, back and shoulder regions respectively of the wearer, said front and rear sections covering a major part of the rib cage of the wearer in said regions from the shoulders downwardly; said external shell comprising pairs of laterally spaced vertically elongated stiffener bands overlying said front and rear sections respectively, said stiffener bands having a length sufficient to extend over most of the height of the wearer's rib cage; a shoulder arch on each side of the garment interconnecting the upper ends of a front and a rear stiffener, each said shoulder arch having parts extending laterally over the clavicle region at the front and back; said stiffener bands and said shoulder arches being of a stiffly flexible material that has a stiffness that is high relative to that of the corresponding garment section so as to be capable of attenuating a localized impact force applied thereto and distributing such force to an enlarged region of the underlying layers of padding; and said garment including attachments between said padding layers and said external shell for retaining the latter in position with respect to said absorption structure, and fastening elements thereon that are adjustable for interconnecting said sections of the garment in fitting relationship to the upper body of the wearer.

Elements of the external shell are preferably fabricated in a light weight high density plastic material such as polyethylene. The elements may be fabricated conveniently by moulding from thermoplastic sheeting of a thickness 2,5 mm. The absorption structure preferably comprises a high density closed cell plastic foam covered by a mesh material such as polyester fabric providing a front and back lining. The foam may be of dual density in selected regions to provide increased protection.

The stiffener bands and shoulder arches of the external shell are preferably formed with an outwardly convex transverse profile and rounded marginal surfaces where they contact the absorption structure. With this arrangement impact encountered by the outwardly spaced convex portions are attenuated and widely distributed to the absorption structure by the rounded margins of the parts. Severe impacts will tend to flatten the convex profile of the stiffener band and thus increase the area of the latter that is pressed against the padded absorption structure.

Preferably the upper ends of the stiffener bands are pivotally attached to the shoulder arches and the lower ends of the stiffener bands are attached to the absorption structure so that the external shell is anchored to the later. The shoulder arches may also be formed with transversely convex profiles to increase their effective stiffness and resistance to impact loads in the same manner as the stiffener band.

Stiff padded convex shoulder caps can be attached to the garment to partially cover the shoulder arches and extend laterally outwardly therefrom. A convex bicep or upper arm pad is suspended from the outer edge of the shoulder arch by an adjustable strap.

The invention also provides a padded protective garment to be worn on a person's upper body, comprising: a front section and a rear section comprising layers of padding for overlying the chest and back regions respectively of the wearer and covering a major part of the rib cage of the wearer in said regions from the shoulders downwardly fastening elements on said garment, said fastening elements being adjustable for interconnecting said sections of the garment in fitting relationship to the upper body of the wearer; a pair of laterally spaced vertically elongated stiffener bands overlying at least one of said front and rear sections; said stiffener bands having a length sufficient to extend over most of the height of the wearer's rib cage; said stiffener bands being of a stiffly flexible material that has a stiffness that is high relative to that of the corresponding garment section so as to be capable of attenuating a localized impact force applied thereto and distributing such force to an enlarged region of the underlying layers of padding; and said garment including attachments for retaining said stiffener bands in position with respect to said padding layers.

BRIEF DESCRIPTION OF THE DRAWINGS

The invention will further be described, by way of example only, with reference to the accompanying drawings, wherein.

DESCRIPTION OF THE PREFERRED EMBODIMENTS

Figure 1:
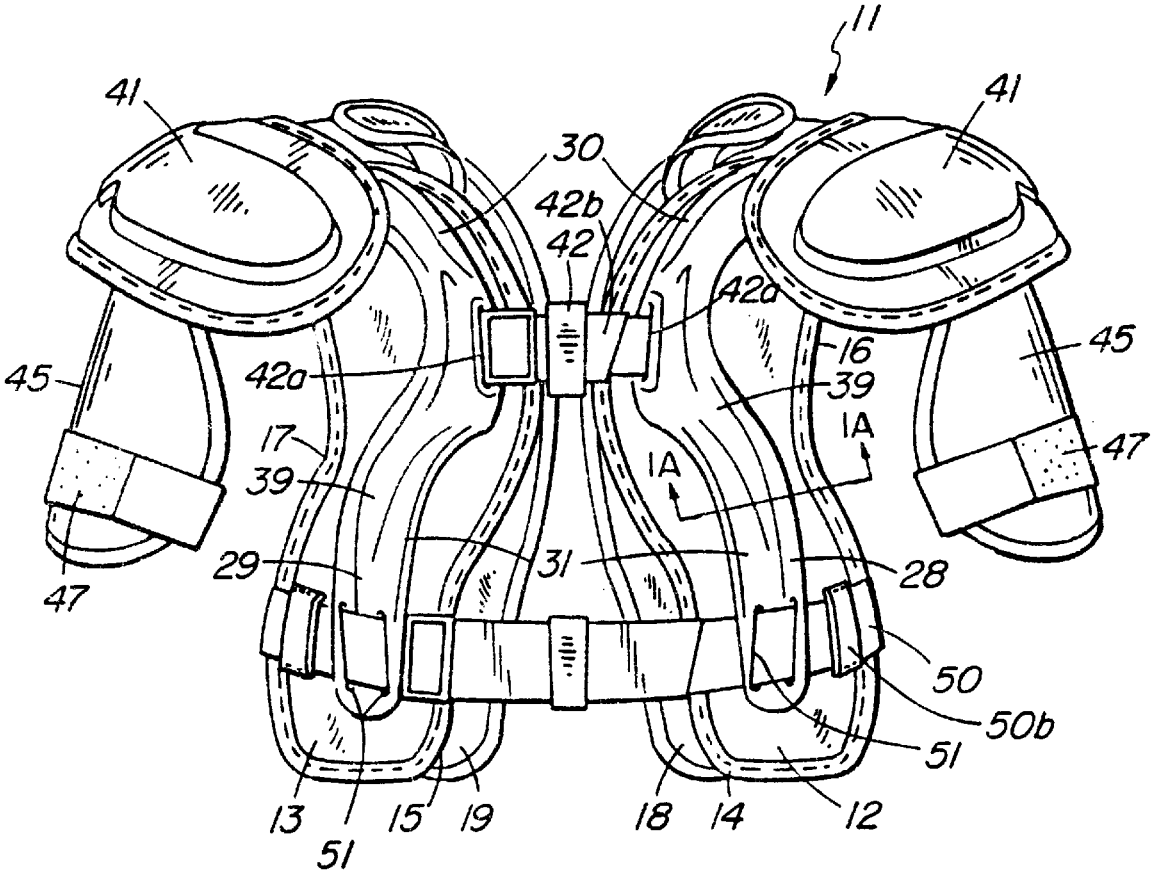
FIG. 1 is an elevation shown in the front of a padded protective garment in accordance with a preferred embodiment of the invention that comprises a set of shoulder pads for an ice hockey player.
Figure 2:
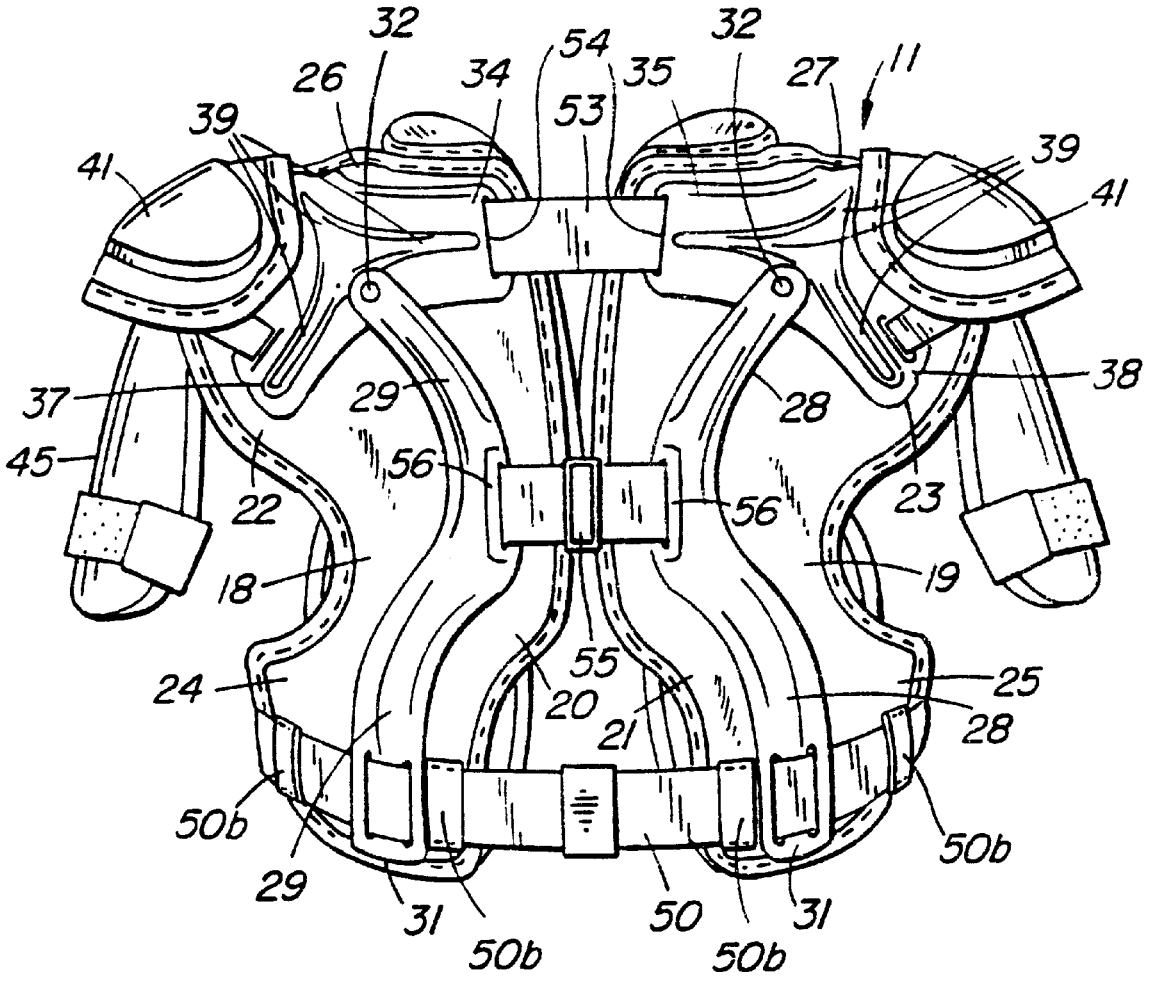
FIG. 2 is a rear elevation of the shoulder pads of FIG. 1.
Figure 5:
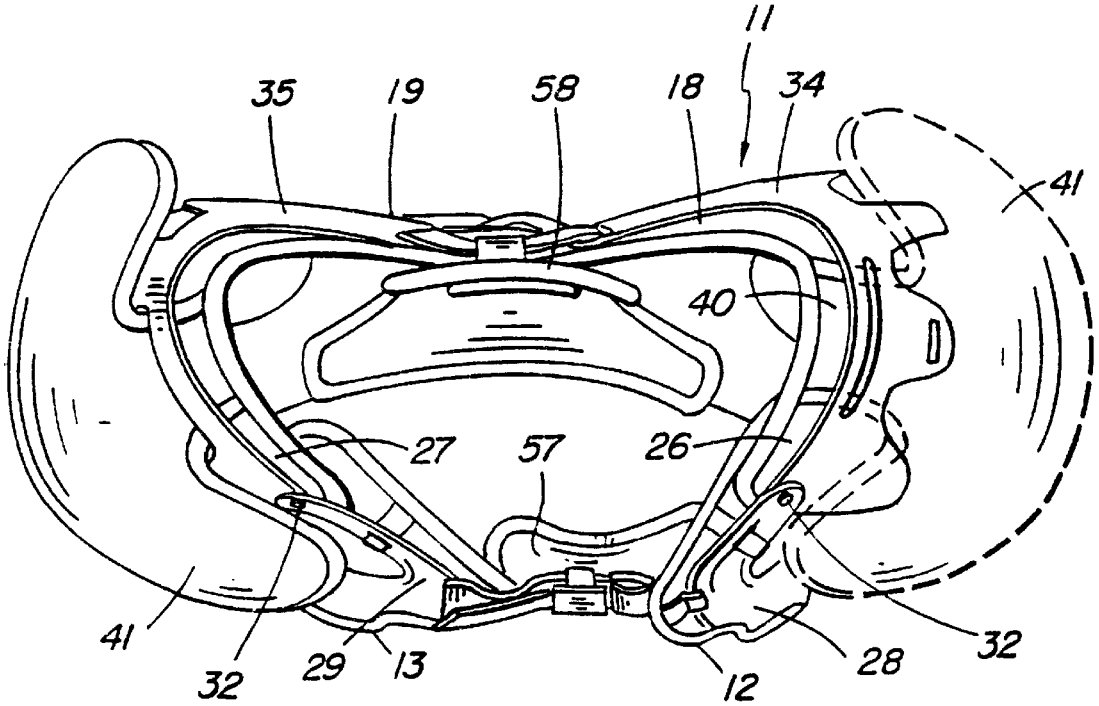
FIG. 5 is a plan view of the shoulder pads of FIG. 3.
Figure 6:
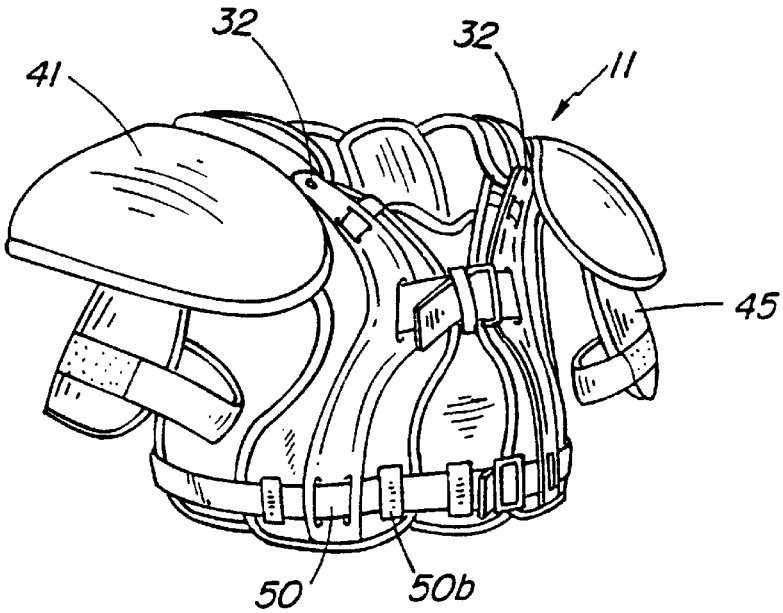
FIG. 6 is a partial side perspective view showing the shoulder pads of FIG. 3 as worn.
Figure 7:
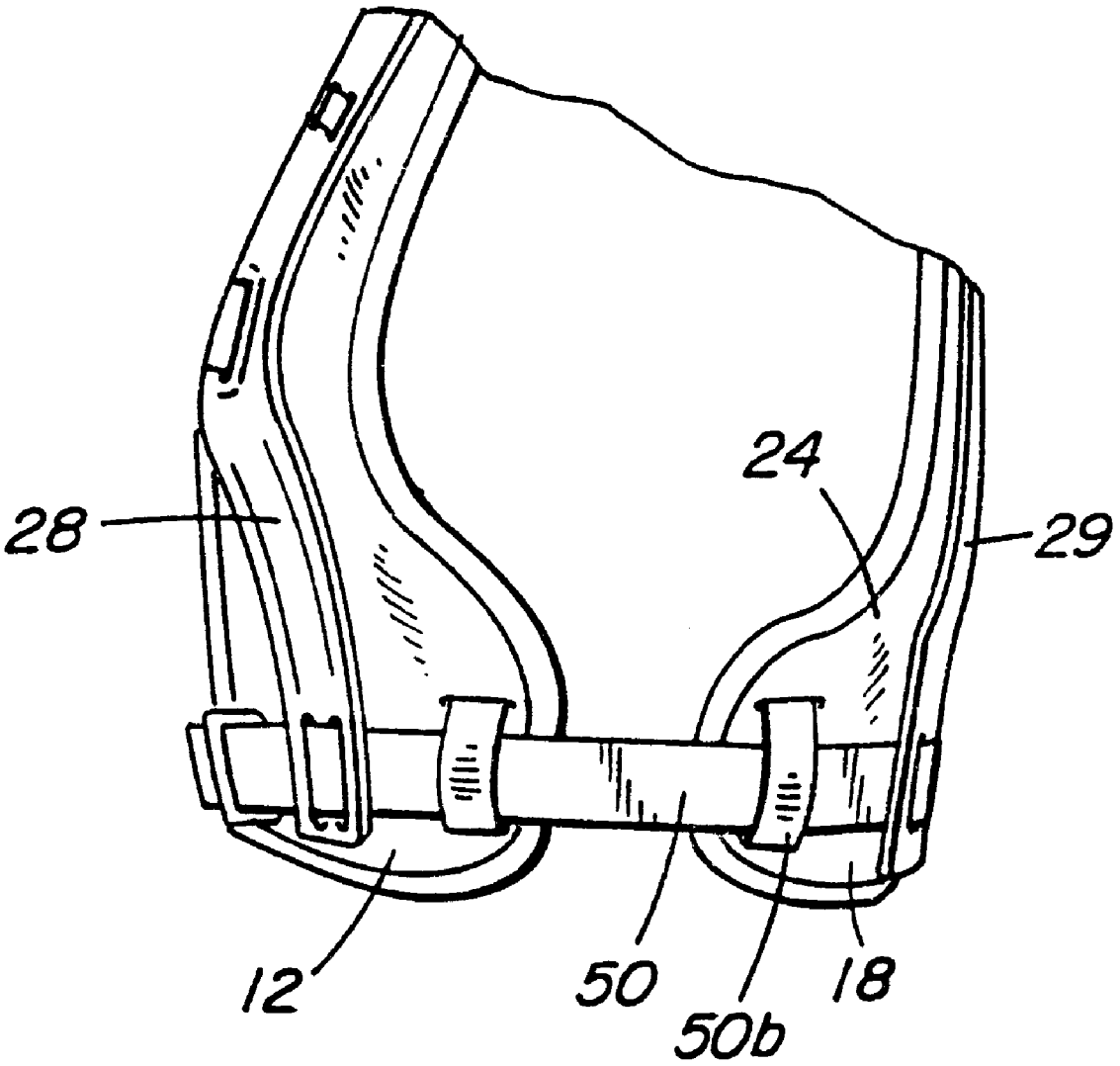
FIG. 7 is a side view of the shoulder pads in use.
Figure 8:
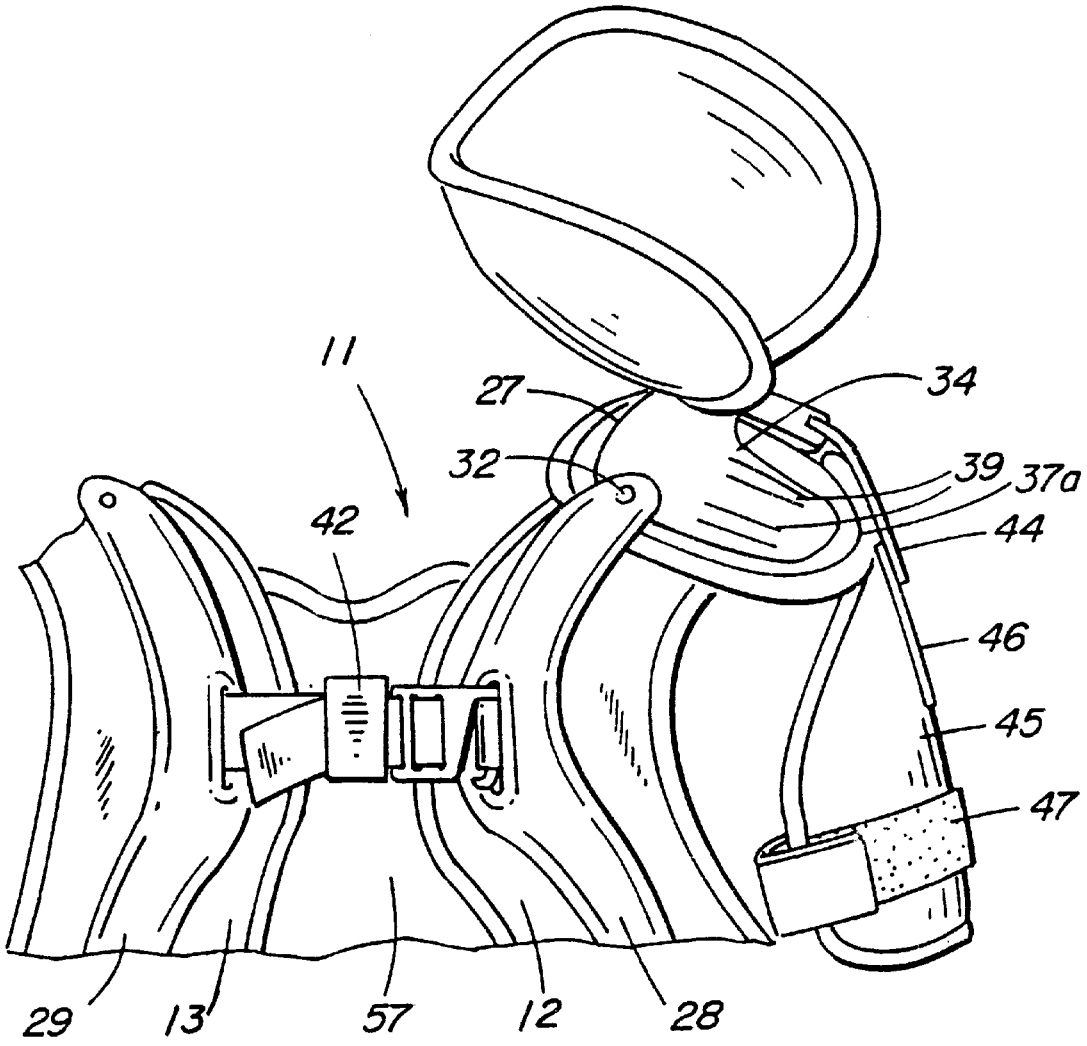
FIGS. 8 and 9 are fragmentary perspective views illustrating details.

Referring to FIGS. 1 and 2, the shoulder pads 11 shown therein comprises on the front left and right sides chest protector pads 12, 13 of wide vertically elongated form, these pads being sized to cover the left and right sides of the wearer's chest from the shoulder region down as far as the bottom of the rib cage, the pads 12 and 13 having on their inner sides confronting edges 14 and 15 which curve convexly towards each other in the sternum region and curve concavely away from each other in the lower region as clearly seen in FIG. 1. The outer edges 16, 17 of the pads 12 and 13 generally follow the curvature of the respective inner edges. On the rear the shoulder pads include left and right back protector pads 18, 19, these being shaped somewhat similarly to the chest pads 12 and 13 but having confronting inner edges 20, 21 that are somewhat more closely spaced, and having lateral shoulder extensions 22, 23 at their upper ends and lateral side extensions 24, 25 at their lower ends. As shown in FIGS. 5 and 8, the upper ends of the chest and back pads are interconnected through respective left and right side shoulder arch pads 26, 27 to which they are pivotally attached. The various pads can be of any suitable composition to provide the degree of cushioning and protection that is desired. Typically the pads comprise a closed cell foam of ethylene vinyl acetate of a thickness 6.5 mm covered by mesh outer layers of a woven synthetic material such as polyester. The dimensions of the pads are such as to provide cushioning material covering vulnerable areas of the wearer's torso, without unduly restricting the freedom of movement of the wearer's body, head or arms.

Superimposed on the arrangement of pads as described above is an external shell of strong relatively stiff material to provide added protection in selected regions of the garment to resist impacts from foreign objects. Thus a vertically elongated stiffening band 28, 29 overlies the respective left and right side chest pads 12 and 13, identical stiffening bands 28, 29 overlying the right and left back protectors 19 and 18 respectively. The bands 28, 29 are mirror images thereof as will be evident from FIG. 1 and each comprises an upper part 30 which curves convexly towards the middle as seen in FIG. 1 and lower parts 31 which diverges downwardly and is curved convexly outwardly.

Figure 1A:
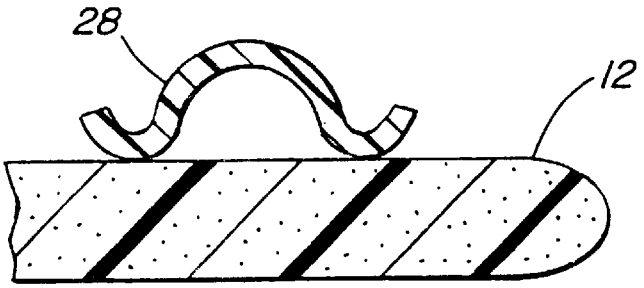
FIG. 1A is a fragmentary sectional view to a larger scale taken on the line 1A—1A in FIG. 1.

The stiffening bands have a width of approximately 40 mm and as seen in FIG. 1A have a transverse profile in which the major central part of the band is convexly curved outwardly away from the underlying pad to a height of about 7.5 mm, and marginal areas that are curved convexly towards the underlying pad. The bands as shown are fabricated from thermoplastic sheeting having a thickness of 2.5 mm. As best seen in FIGS. 2, 4, 5 and 8, the external shell also includes left and right side shoulder arches 34, 35 which overlie the corresponding shoulder arch pads 26 and 27. The upper end of stiffener bands 28 and 29 are pivotally attached to shoulder arches 34 and 35 at connection points 32 located on each side of shoulder arches 34 and 35. As with the bands 28, 29, the shoulder arches 34, 35 are similarly moulded from thermoplastic sheeting, and each includes on its front and rear sides a laterally outwardly extending projection 37, 38 (rear) and 37*a*, 38*a* (front) to provide protection to the clavicles and shoulder blades of the wearer. As with the bands 28, 29, the shoulder arches 34, 35 are formed front and rear with moulded stiffening ribs 39 which extend in the lateral direction thereof and project convexly outwardly.

The shoulder arch pads 26, 27 provide in known manner a mounting attachment for a strap 40 which attaches a shoulder cap pad 41 of known design to extend laterally outwardly over the shoulder of the wearer, the strap 40 extending beneath the respective shoulder arch 34, 35 as seen in FIG. 5.

Figure 9:
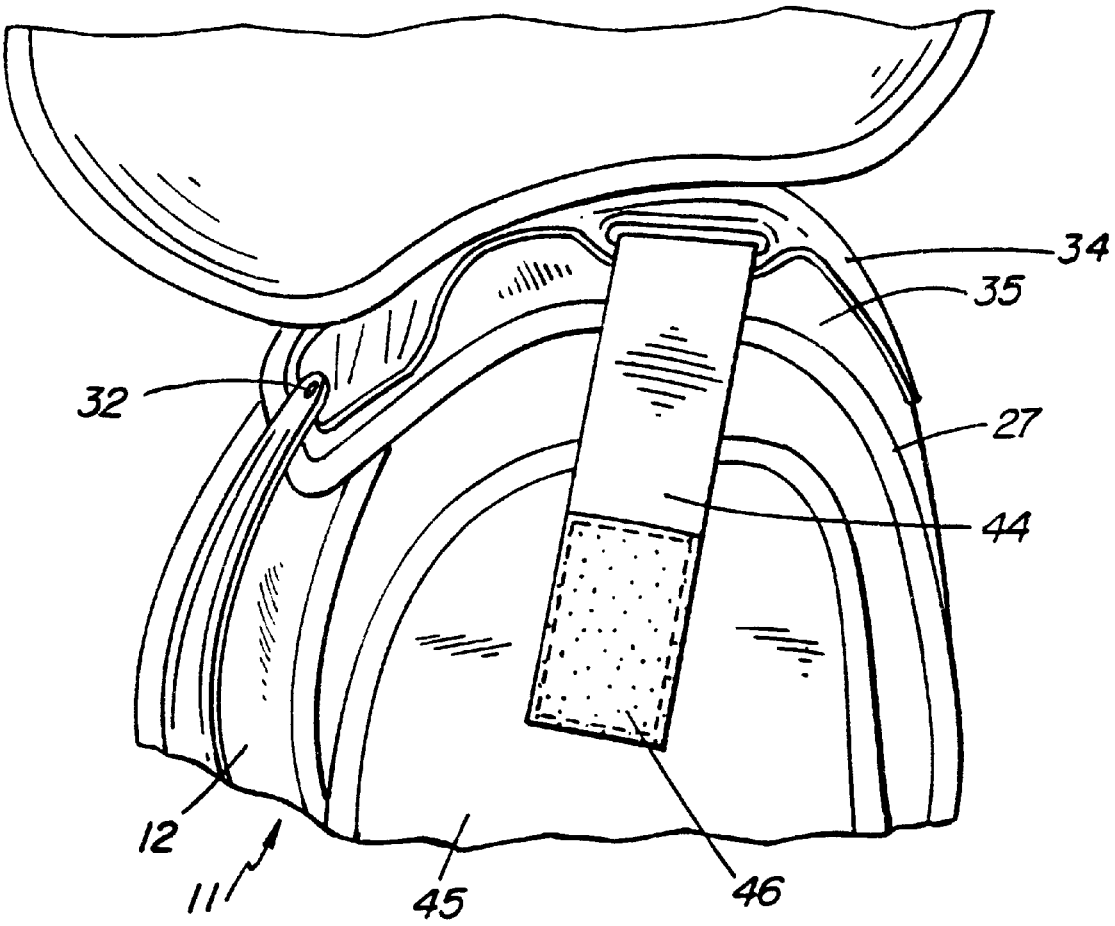

As seen in FIG. 9, the shoulder arch 34 includes a slot 42 through which is threaded a strap 44 which attaches a padded bicep pad 45 designed to protect the bicep and outer portion of the upper arm of the wearer. A like pad 45 is similarly mounted on the opposite shoulder arch. A hook and pile fastening arrangement 46 such as Velcro™ provided on the looped strap enables vertical adjustment of the bicep pad 45, the pad in known manner including an elasticized strap loop 47 to position it in relation to the wearer's arm.

Figure 1B:
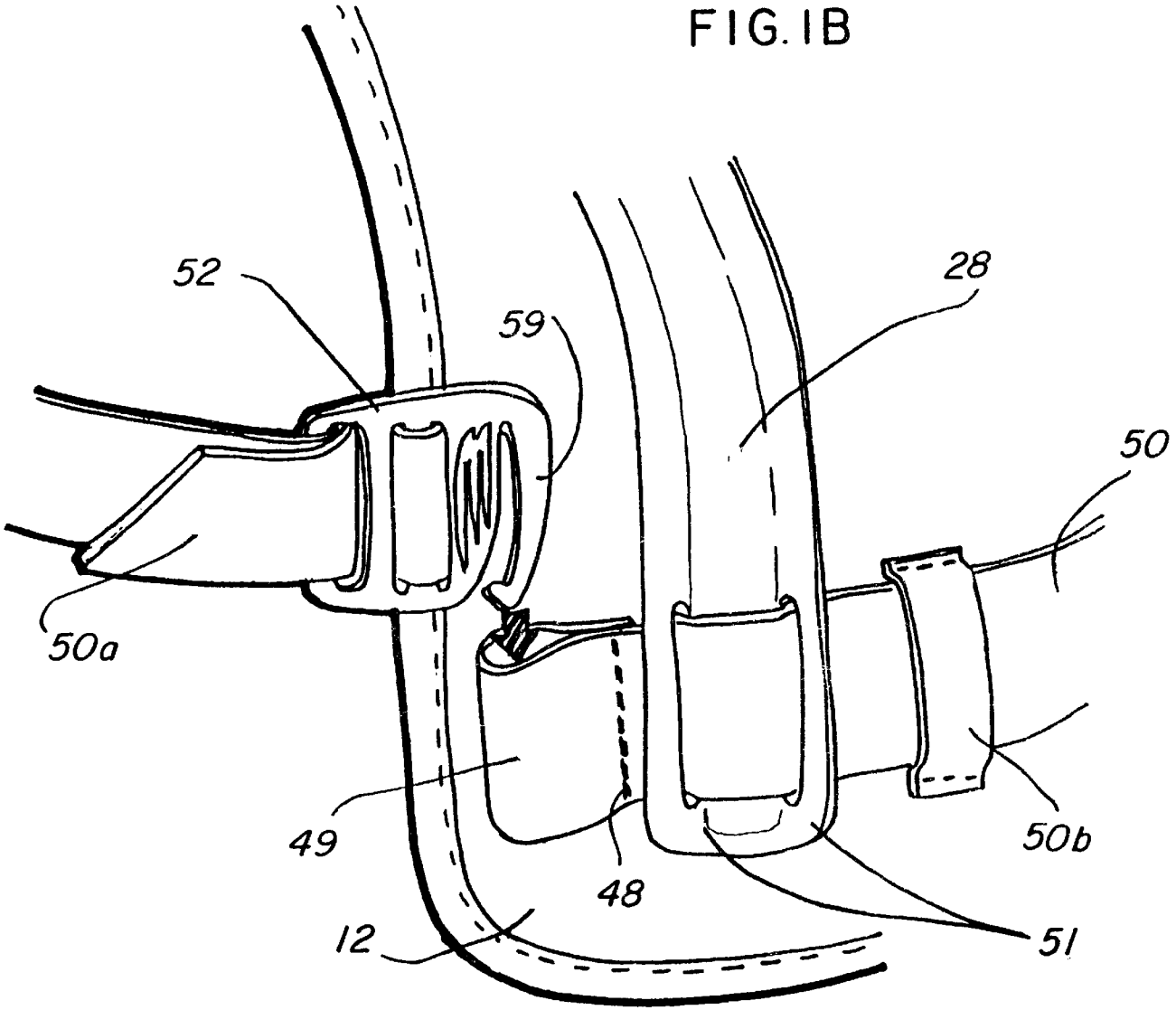
FIG. 1B is an enlarged detail view of a portion of the garment of FIG. 1.

The various parts of the shoulder pads are interconnected by an arrangement of adjustable fasteners to secure them together and to enable them to be fitted snugly to the body of the wearer. Thus a lower elasticized woven fabric strap 50 is passed through belt loops across the lower ends of the back pads 18 and 19, extends forwardly at the sides to the respective front pads 12 and 13. As best shown in FIG. 1B, one end of the strap is stitched as at 48 to the front pad 12 this end forming a looped eye 49. The strap 50 through slots 51 near the lower ends of the stiffening band 28 and from there the strap 50 extending all around like a belt passing successively over and between the right front pad 12, the left and right back pads 18, 19 and the front pad 13.

As seen in FIG. 1B the opposite end of the strap 50 is threaded through a series of slots in a fastener plate 52, the projecting end 50*a* of the strap 50 being adjustable through the fastener plate 52. The fastener plate 52 is formed with a downwardly projecting rigid elongate hook 59 which is insertable into the eye 49 formed at the first end of the belt. Belt loops 50*b* are positioned around the pads 12, 13, 18 and 19 to guide the belt 50.

An upper adjustable strap arrangement 42 interconnects the upper regions of the front pads 12 and 13. Specifically, the strap arrangement 42 has opposite ends anchored in slots 42*a* in the stiffening bands 28, 29, the two parts being interconnected by an adjustable fastener arrangement 42*b* which is similar to that employed by the lower strap 50.

A rear upper strap 53 extends between slots 54 on the inboard ends of the shoulder arches 34, 35. A lower rear strap 55 extends between slots 56 in confronting portions of the stiffening bands 28, 29. The straps 53 and 55 may include hook and pile fastenings for adjusting the lengths thereof when the garment is being fitted to the wearer's body.

Figure 3:
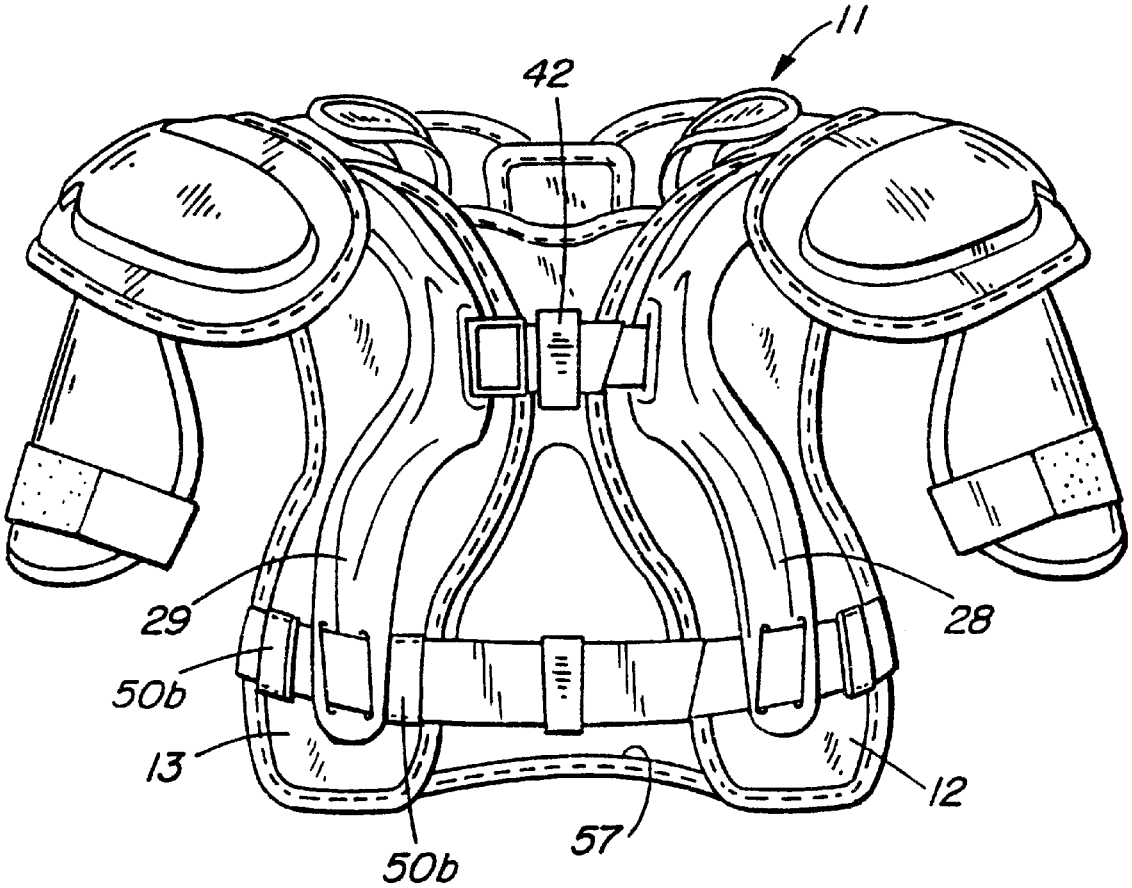
FIG. 3 is a front elevation of the shoulder pads of FIG. 1 modified by the addition of further protective padding.
Figure 4:
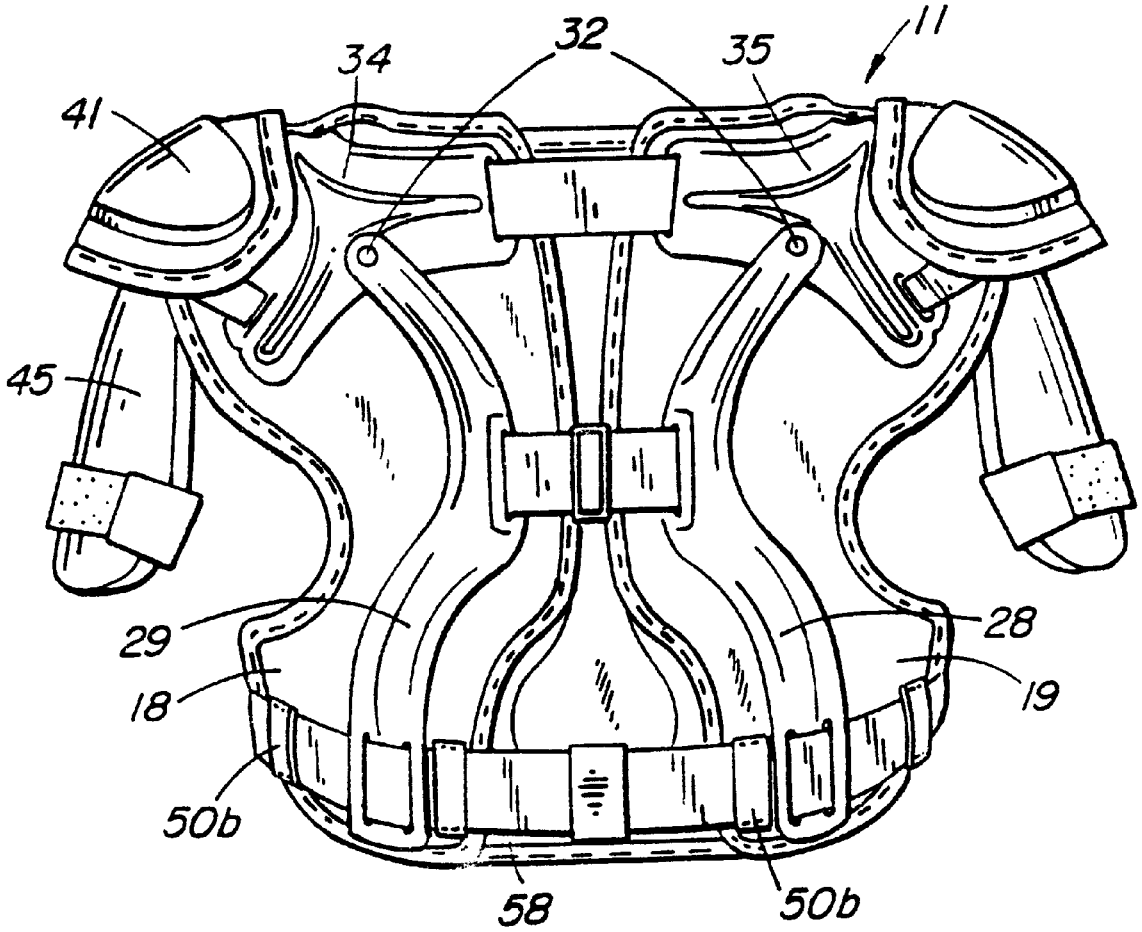
FIG. 4 is a rear elevation corresponding to FIG. 3.

As shown in FIGS. 3 and 4, the garment may include additional padding in the form of a sternum pad 57 and a spinal pad 58. As seen in FIG. 5, these pads lie against the inner sides and overlap the edges of the chest and back protector pads 12, 13, 18 and 19 and provide an additional measure of padding in these regions, albeit at the cost of some loss in the freedom of movement of the wearer. These pads 57, 58 are of similar construction and fabrication to the other pads.

Figure 10:
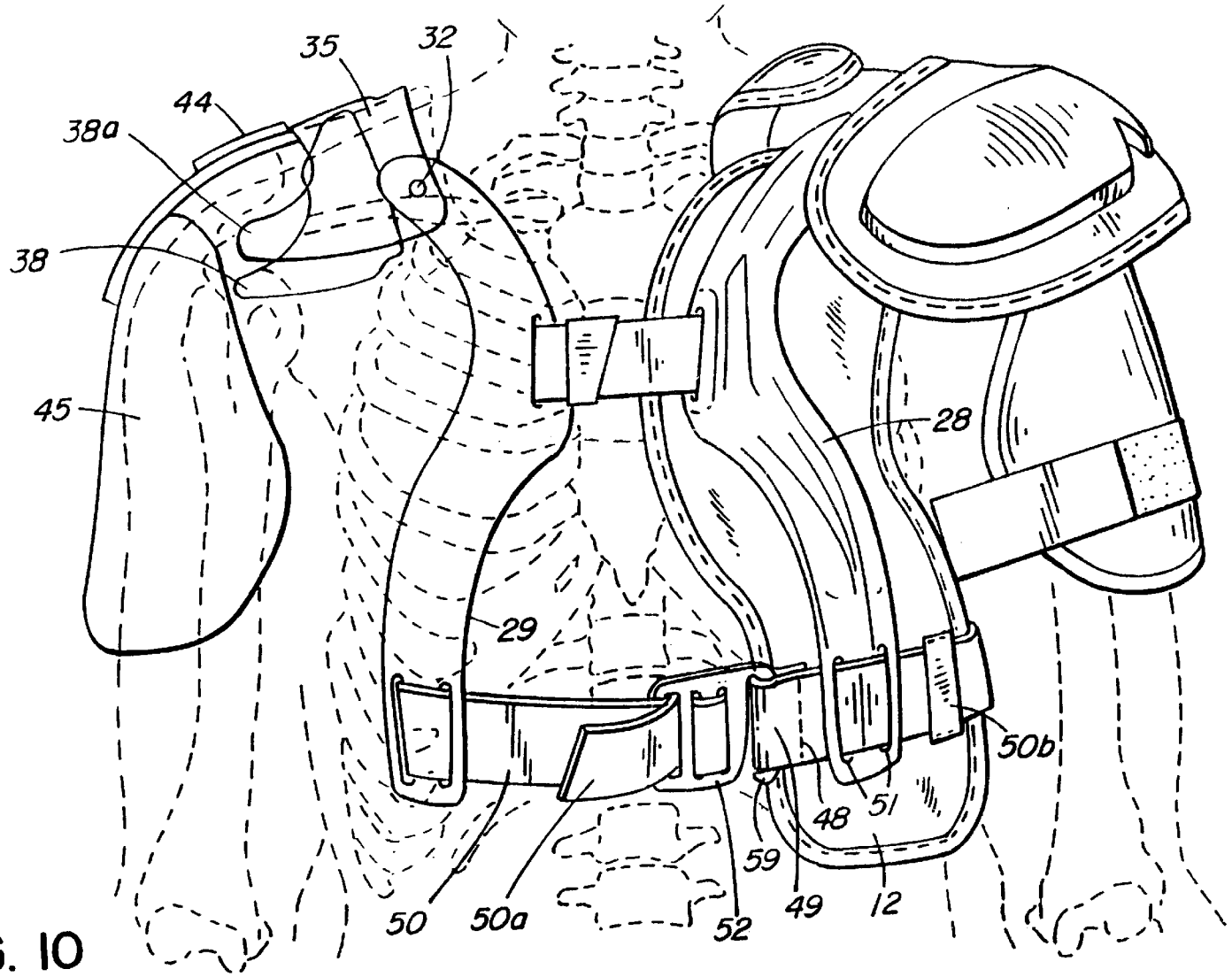
FIG. 10 is a somewhat schematic view from the front showing the shoulder pads of FIG. 1 positioned in relation to the torso of a wearer.

FIG. 10 provides an illustration of how the shoulder pads of FIG. 1 match the skeletal structure of the wearer. In particular, the left side of FIG. 10 shows how the stiffening bands 28, 29 are matched to the rib cage of the wearer and provide lightweight but effective protection for the ribs. Similarly this figure shows how the shoulder arch 35 provides protection for the clavicle of the wearer.

Thus the elongate relatively narrow stiffening bands 28, 29 extend along critical areas of the wearer's body and in their location on the outer side of the full protection pads provide excellent dispersion of impact loads which they are positioned to intercept. For example they can protect the wearers body against stick impacts as occur in the game of ice hockey through cross-checking.

The improved shoulder pads provide an effective degree of protection while offering very little restriction to the freedom of movement of the wearer. Once the wearer has adjusted the various straps to optimize the positioning of the pads relative to the wearer's body, then the garment can be put on and taken off like a vest requiring only fastening or undoing the two straps at the front. The shoulder pads provide better protection than traditional lightweight shoulder pads while maintaining good ergonomics and aeration.

The external shell components are not expert to manufacture since no injection moulding is necessary, but rather the components can be compression moulded from plastic sheeting, since none of the components has a complex profile.

The stiffening bands can be attached to the garment by any suitable means such as rivets, sewing or the like The stiffening bands on the rear of the garment provide effective protection to the spine of the wearer against cross checks by hockey sticks since due to the projected convex profile of the bands and the thickness of the underlying protective pads, the bands will intercept and shield the spine from contact by hockey stick thrust horizontally towards the players back.

I claim:

1. A padded protective garment to be worn on a person's upper body, comprising an absorption structure to be positioned adjacent the body and an external shell disposed outwardly on said absorption structure; said absorption structure comprising:

a front section, a rear section and a shoulder section, each comprising layers of padding for overlying the chest, back and shoulder regions respectively of the wearer, said front and rear sections covering a major part of the rib cage of the wearer in said regions from the shoulders downwardly;

said external shell comprising pairs of laterally spaced apart vertically elongated stiffener bands overlying said front and rear sections respectively, each said stiffener band having a narrower configuration than an underlying padding section of said absorption structure, a single connection point near its upper end, and a length sufficient to extend over most of the height of the wearer's rib cage; and a shoulder arch on each side of the garment which interconnects the upper ends of said front and rear stiffener bands at said connection points, each said shoulder arch having parts extending laterally over the clavicle region at the front and over the shoulder blade at the back;

said stiffener bands and said shoulder arches being of stiffly flexible material that has a stiffness that is high relative to that of the corresponding underlying padding section so as to be capable of attenuating a localized impact force applied thereto and distributing such force to an enlarged region of the underlying layers of padding;

said garment including attachments between said padding layers and said external shell for retaining the latter in position with respect to said absorption structure, and fastening elements thereon that are adjustable for interconnecting sections of the garment in fitting relationship to the upper body of the wearer.

2. A garment as defined in claim 1, wherein said shoulder arch has opposite ends attached to corresponding stiffener bands at said connection points thereby allowing relative pivotal movement between said stiffener bands and said shoulder arch.

3. A garment as defined in claim 2, wherein said shoulder arch is adapted to rotate upwardly or downwardly along an axis defined by said connection point of each said stiffener band connected thereto.

4. A garment as defined in claim 3, wherein said front stiffener bands are generally opposing S-shape members arching inwardly from said connection points near the left and right clavicle regions to the inner part of the sternum region and arching outwardly from the sternum region to the outer regions of the mid-section.

5. A garment as defined in claim 4, wherein said front stiffener bands are shaped and positioned to substantially cover the central region of the rib cage.

6. A garment as defined in claim 4, wherein said rear stiffener bands are generally opposing S-shape members arching inwardly from said connection points near the left and right shoulder regions to the inner part of the mid-section of the back and arching outwardly from the mid-section of the back to the outer regions of the lower back.

7. A garment as defined in claim 3, wherein said stiffener bands have a transverse profile that includes a convexly outwardly projecting intermedicate part.

8. A garment as defined in claim 6, wherein said stiffener bands have rounded longitudinal edges confrontingly engaging said padding layers.

9. A garment as defined in claim 3, further comprising a stiff padded convex shoulder cap having an inboard edge attached to said shoulder section of padding, said inboard edge engaging an aperture of said shoulder arch.

10. A garment as defined in claim 9, further comprising a biceps protector adjustably attached to said shoulder arch to be suspended therefrom in a position covering the outer side of the upper arm of the wearer.

11. A garment as defined in claim 8, wherein said fastening elements are engaging said stiffener bands.

12. A padded protective garment to be worn on a person's upper body comprising an absorption structure to be positioned adjacent the body and an external shell disposed outwardly on said absorption structure; said absorption structure comprising:

a front section, a rear section and a shoulder section, each comprising layers of padding for overlying the chest, back and shoulder regions respectively of the wearer, said front and rear sections each divided into a left and right portion;

said external shell comprising pairs of laterally spaced apart vertically elongated stiffener bands overlying said front and rear sections respectively, one on each said left and right portion; each said stiffener band having a narrower configuration than said underlying left or right portion, a single connection point near its upper end, and having a length sufficient to extend over most of the height of the wearers rib cage; and a shoulder arch on each side of the garment which interconnects the upper end of said front and rear stiffener bands at said connection points, each said shoulder arch having parts extending laterally over the clavicle region at the front and over the shoulder blade at the back, said parts attached to said front and rear stiffener bands at said connection points thereby allowing relative pivotal movement between said stiffener bands and said should arch;

said stiffener bands and said shoulder arches being of stiffly flexible material that has a stiffness that is high relative to that of the corresponding underlying padding section so as to be capable of attenuating a localized impact force applied thereto and distributing such force to an enlarged region of the underlying layers of padding;

said garment including attachments between said padding layers and said external shell for retaining the latter in position with respect to said absorption structure, and fastening elements thereon that are adjustable for interconnecting sections of the garment in fitting relationship to the upper body of the wearer.

* * * * *